US005341538A

United States Patent [19]

Banome

[11] Patent Number: 5,341,538

[45] Date of Patent: Aug. 30, 1994

[54] SUN LOTION APPLICATOR

[75] Inventor: Anthony Banome, Brooklyn, N.Y.

[73] Assignee: Sun Stix Incorporated, Brooklyn, N.Y.

[21] Appl. No.: 27,021

[22] Filed: Mar. 5, 1993

[51] Int. Cl.[5] ..... A47K 7/02; A47L 13/46

[52] U.S. Cl. ..... 15/210.1; 15/145; 15/209.1; 401/207

[58] Field of Search ..... 15/104.94, 208, 209.1, 15/210.1, 220.1, 228, 231, 232, 244.1, 145; 604/1; 401/203, 204, 207

[56] References Cited

U.S. PATENT DOCUMENTS

| | | | |
|---|---|---|---|
| 346,773 | 8/1886 | Rees . | |
| 719,596 | 2/1903 | Lauterbach | 15/209.1 X |
| 1,073,155 | 9/1913 | Miller . | |
| 1,372,783 | 3/1921 | Smith . | |
| 1,829,287 | 10/1931 | Lovett | 401/204 |
| 1,863,778 | 6/1932 | Welsh . | |
| 2,042,546 | 6/1936 | Meier | 15/145 X |
| 2,384,178 | 9/1945 | Kincaid . | |
| 2,501,289 | 3/1950 | Orndorff | 401/204 |
| 2,726,418 | 12/1955 | Hempel . | |
| 2,736,913 | 3/1956 | Mirth . | |
| 2,808,605 | 10/1957 | Licata . | |
| 2,829,393 | 4/1958 | Turcotte . | |
| 2,936,475 | 5/1960 | Johns . | |
| 3,128,493 | 4/1964 | Paul . | |
| 3,131,419 | 5/1964 | Vosbikian et al. | 401/207 X |
| 3,221,356 | 12/1965 | Schirmer . | |
| 3,383,158 | 5/1968 | Leland . | |
| 3,463,302 | 8/1969 | Preston . | |
| 3,474,480 | 10/1969 | Young | 15/244.1 X |
| 3,562,838 | 2/1971 | Burton et al. | 15/244.1 |
| 3,753,267 | 8/1973 | Johnson, Sr. | 15/210.1 |
| 4,078,865 | 3/1978 | Moser . | |
| 4,184,221 | 1/1980 | Edwards . | |
| 4,224,713 | 9/1980 | Trent | 15/210.1 |
| 4,483,636 | 11/1984 | Meyer . | |
| 4,861,180 | 8/1989 | Adams . | |
| 4,896,984 | 1/1990 | Evans . | |
| 4,934,011 | 6/1990 | Haug | 15/145 |
| 4,976,000 | 12/1990 | Wiley . | |
| 5,012,544 | 5/1991 | Verry . | |
| 5,058,234 | 10/1991 | Humenay . | |

FOREIGN PATENT DOCUMENTS

| | | | |
|---|---|---|---|
| 1325295 | 8/1973 | United Kingdom | 401/207 |

*Primary Examiner*—Timothy F. Simone
*Assistant Examiner*—Charles Cooley
*Attorney, Agent, or Firm*—Lerner, David, Littenberg, Krumholz & Mentlik

[57] ABSTRACT

A lotion applicator for applying sun lotion or the like comprising an elongate handle and detachable lotion applicator pad assembly. The applicator assembly preferably includes a pair of pad members stitched about their outer edges except at an opening to define a pocket therebetween. Within this pocket, at least one, and preferably two, semi-rigid reinforcing members are disposed and correspond substantially to the shape of the pad members. A handle receptacle member having a handle receiving chamber is disposed between the reinforcing members and attached to at least one of the reinforcing members. The handle receiving chamber is formed to correspond to the contour of the distal end of the handle to snugly receive the same when inserted in the pocket.

12 Claims, 3 Drawing Sheets

SUN LOTION APPLICATOR

FIELD OF THE INVENTION

The present invention relates to the field of lotion applicators for applying sun lotion or the like to portions of the human body, and more particularly relates to a lotion applicator having an elongate handle and a removable and replaceable lotion applicator pad assembly attached thereto.

BACKGROUND OF THE INVENTION

It is often necessary and desirable to apply lotions such as sun lotion, moisturizer, as well as other ointments, to various portions of the human body such as the arms, legs, chest, and hard to reach areas such as the back. For example, when sunbathing at the beach or other location, it is often desirable to apply sun lotion to all areas of the body exposed to sunlight to protect from the sun's harmful rays. When alone, however, it is often difficult for individuals to apply the sun lotion by themselves to areas of their body that are difficult to reach using only their hands. Moreover, it is often desirable to apply sun lotion to the body without getting the sun lotion all over one's hands. Accordingly, a variety of different types of lotion applicators have been designed for applying lotions to desired portions of the human body. Additionally, in a related field, many bathing brushes have been designed for applying soap to one's body or for scrubbing one's body, especially the back area.

For example, many lotion applicators have a removable lotion pad that is wrapped around or stretched over the head of a handle. U.S. Pat. No. 2,829,393 to Turcotte discloses such a cosmetics and lotion applicator which provides a porous applicator pad that is stretched over the head of a handle. Likewise, U.S. Pat. No. 2,936,475 to Johns discloses a suntan lotion applicator wherein a pad is wrapped around a body of the applicator which comprises a box provided with a telescoping handle for holding a bottle of lotion, makeup or the like. The pad is attached to the box by its edges being engaged by sawtooth edges on the sides of the box. U.S. Pat. No. 346,773 to Rees discloses another bath pad that is retained on the head of the handle by stretching the pad over a head provided with a pair of plates. The side edges of the pad are inserted between the two plates which are then clamped down using a set screw to thereby retain the bath pad.

In the field of bath brushes, many brushes have been designed which employ a bathing or wash cloth wrapped or stretched over the head of a handle. For example, U.S. Pat. No. 4,184,221 to Edwards discloses a bath brush having an elongated handle with brush bristles at one end. A pair of clips are provided on the head of the brush about the bristles for removably retaining a washcloth. Likewise, U.S. Pat. No. 5,012,544 to Verry discloses a multi-purpose bathing wiper with a handle having a plate at one end. A pair of straps are secured to the plate and removably receive a sheet-like washcloth.

A number of lotion applicators employ a lotion reservoir and a hollow handle designed to supply the lotion from the reservoir through the handle to the head of the applicator. For instance, U.S. Pat. No. 4,861,180 to Adams and U.S. Pat. No. 4,896,984 to Evans, disclose lotion applicators with the applicator member being shaped like a human hand for realistic simulation of applying lotion to one's body with a human hand.

Despite all of these lotion applicators and bath brushes, there is still a further need to provide an improved sun lotion applicator with replaceable lotion pads. Such lotion applicator should be simple to use, inexpensive to manufacture, marketable as a novelty item, and still provide excellent transfer of lotion from the lotion pad to the body.

SUMMARY OF THE INVENTION

Thus, one aspect of the present invention provides a lotion applicator for applying sunlotion or the like, comprising an elongate handle having a proximal end and a distal end; a detachable lotion applicator pad assembly comprising at least one porous, flexible pad member, and at least one semi-rigid reinforcing member disposed on the pad member and corresponding substantially to the shape of the pad member; and fastening means for removably securing the pad assembly to the distal end of the handle.

In the preferred embodiment, two porous, flexible pad members are provided, the pad members are attached substantially about their outer edges to define an opening forming a pocket, and the reinforcing member is disposed in the pocket. More preferably, the pocket is outlined by a top edge, two side edges, and a bottom edge having a predetermined length, the opening being formed along the bottom edge and having a length less than the length of the bottom edge.

In another preferred embodiment, the fastening means are operative to fasten the distal end of the handle to the reinforcing member when the distal end of the handle is in the pocket, the fastening means preferably including at least one fastening element disposed on the distal end of the handle and at least one corresponding fastening element disposed on at least one of the reinforcing members. Preferably, two reinforcing members are provided and disposed in the pocket with the fastening means being operative to connect the distal end of the handle to at least one of the reinforcing members when the distal end is disposed between the two reinforcing members.

In the preferred embodiment, the pad assembly further comprises means to firmly retain the distal end of the handle between the reinforcing members to prevent the distal end of the handle from moving, slipping or sliding about within the pocket. In another preferred embodiment, a handle receptacle member is attached to at least one of the reinforcing members and has a body defining a handle receiving chamber therein, the chamber being formed to correspond to the contour of the distal end of the handle to snugly receive the same.

In still another preferred embodiment, the means to firmly retain the distal end of the handle comprises a plurality of posts disposed on a surface of one of the reinforcing members and the posts projecting from such reinforcing member toward the other reinforcing member, the post being positioned in two parallel rows space apart to a width closely matching a width of the distal end of handle, and a plurality of post receptors on the other reinforcing member, the post receptors being disposed in a pattern corresponding to the row of posts such that when the reinforcing members are closed upon one another, the posts are retained in the post receptors and a handle receiving space is formed by the parallel rows of the post and post receptors to receive and retain the distal end of said handle.

The fastening means preferably includes two fastening elements disposed on the distal end of the handle and two corresponding fastening elements mounted on each of the reinforcing members, the fastening elements in corresponding fastening elements preferably comprising hook and loop fasteners.

Preferably, reinforcing members are disposed in the pocket and are not attached to one another about their outer edges in order to provide increased flexure of the pad assembly. Furthermore the reinforcing members are preferably nonporous to allow excess amounts of lotion applied to the pad members to be forced or squeezed out from within the pad members when pressure is applied to the pad members against the reinforcing members.

In accordance with another aspect of the present invention, a detachable lotion applicator pad assembly for use with a lotion applicator having a handle is provided.

DETAILED DESCRIPTION OF THE PREFERRED EMBODIMENTS

Figure 1:
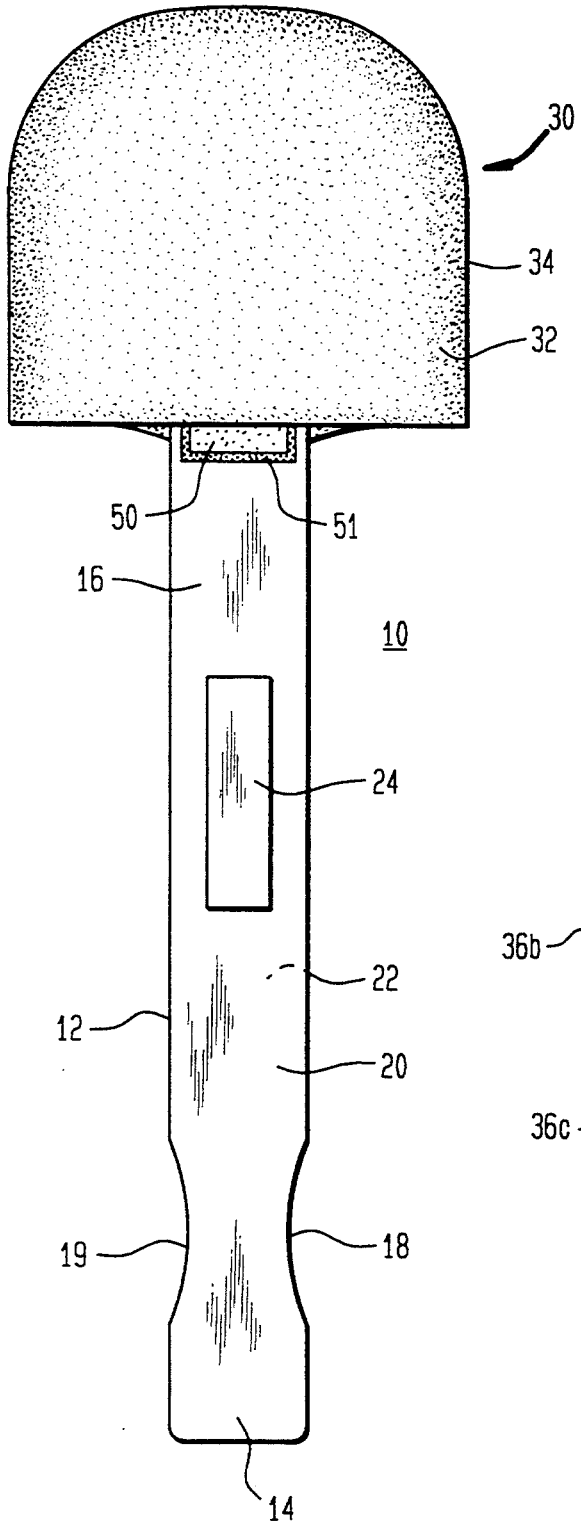
FIG. 1 is a front view of a lotion applicator according to one embodiment of the present invention.

Referring specifically to the Figures in which like numerals refer to like portions thereof, FIG. 1 illustrates a preferred embodiment of a lotion applicator for applying sun lotion or the like, generally designated at 10. Lotion applicator 10 includes an elongate handle 12, having a proximal end portion 14 and a distal end portion 16. Proximal end portion 14 is preferably provided with a contoured grip defined by a pair of inwardly contoured edges 18 and 19 to provide a comfortable feel and to assist the user in gripping and holding handle 12 while applying the sun lotion or the like. Elongate handle 12 is generally flat and has a front surface 20 and opposed rear surface 22. Disposed on one or both of front surface 20 and/or rear surface 22, is a logo 24 for the placement of a business name or the like, although other such indicia and writings can be placed thereon. Handle 12 is preferably fabricated from a lightweight yet sturdy and rigid material such as wood or plastic, and preferably has a width of about $1\frac{1}{8}''$, a length of about 12", and a thickness of about $\frac{1}{8}''$.

Lotion applicator 10 further includes a detachable lotion applicator pad assembly, generally designated as 30, which in a preferred embodiment includes a pair of porous, flexible pad members 32 and 34 as shown in FIGS. 1, 2, 3, and 4 of the drawings. Pad members 32 and 34 can be constructed from a variety of porous fabrics capable of absorbing sun lotions or the like, and are preferably fabricated from a suitable cotton gauze material.

Pad members 32 and 34 should be sturdy enough to withstand multiple applications of lotion and yet be relatively inexpensive to manufacture such that when worn out, they can be discarded and readily replaced. Pad members 32 and 34 are formed to have a corresponding contour and shape and are attached about their outer edges 36, preferably by stitching, except across the bottom where a portion of the outer edges forms an opening 38 to define pocket 40 disposed between pad members 32 and 34 (see FIG. 2).

Figure 2:
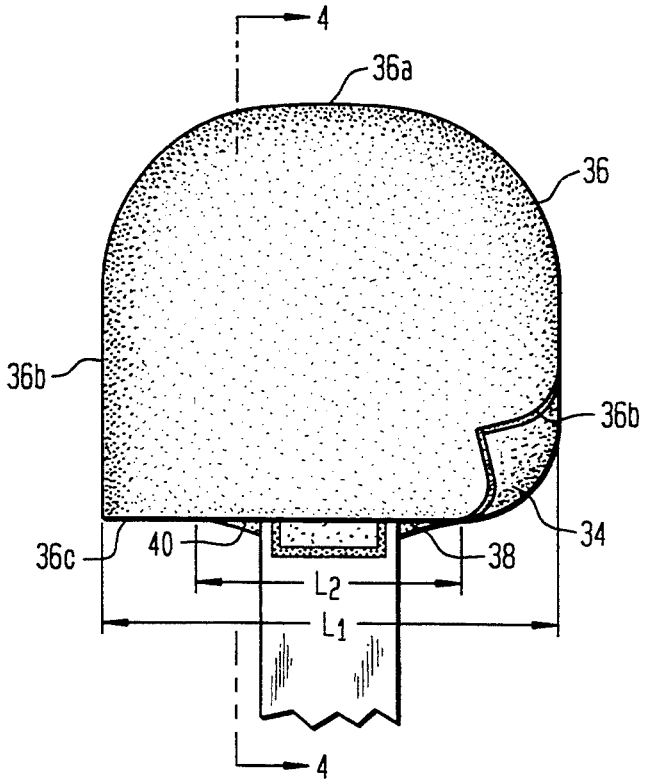
FIG. 2 is a front view of a top portion of the lotion applicator of FIG. 1 including a pad assembly according to one embodiment of the present invention with a corner upturned to reveal the back side of the pad assembly.
Figure 3:
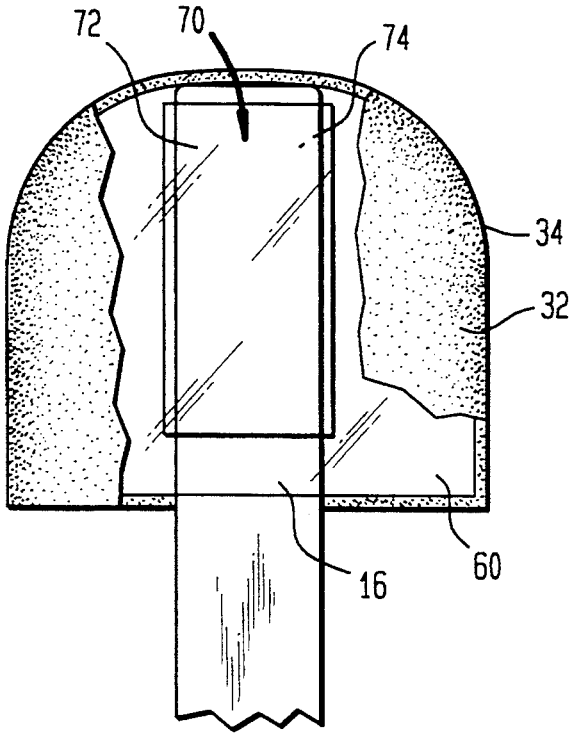
FIG. 3 is a front view of the top portion of the lotion applicator of FIG. 2 with a portion of the pad assembly broken away for clarity of illustration.
Figure 4:
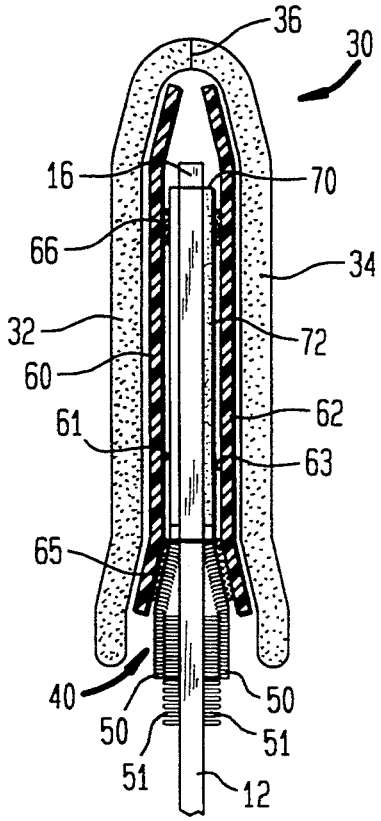
FIG. 4 is a cross-section taken along line 4—4 of FIG. 2.

In FIGS. 2, 3 and 4, pocket 40 is defined by pad members 32 and 34 when stitched about their outer edges 36 as outlined by a top arcuate edge **36*a*, two side edges 36*b* and the bottom edge 36*c*. Bottom edge 36*c* has a first length L1 with an opening 38 extending parallel thereto and formed along bottom edge 36*c*. Opening 38 has a second length L2 which is less than first length L1 of bottom edge 36*c*. In the preferred embodiment, pad members 32 and 34 are stitched about top edge 36*a*, side edges 36*b* and heat fused along on an edge 36*c* except at opening 38 to pocket 40**.

Referring now to FIG. 3, disposed within pocket 40 is at least one semi-rigid reinforcing member 60. Reinforcing member 60 is formed to correspond to and substantially match the shape and contour of pad members 32 and 34 and provides necessary support to pad members 32 and 34 and applicator pad assembly 30. In the illustrated embodiment, two reinforcing members are provided, as will be described more fully below.

Detachable lotion applicator pad assembly 30, in a preferred embodiment, also includes a handle receptacle member 70 adapted to prevent distal end portion 16 of handle 12 from moving, slipping or sliding about in pocket 40 when inserted therein. Accordingly, handle receptacle member 70 includes a body 72 defining a handle receiving chamber 74 therein formed to correspond to the contour of distal end portion 16 of elongate handle 12 to snugly receive and retain distal end portion 16.

In FIG. 4, lotion applicator 10 is shown in a partial cross-sectional view to show reinforcing members 60 and 62 disposed within pocket 40 of pad assembly 30 with each reinforcing member disposed between a pad member 32 and 34 and handle receptacle member 70. Unlike pad members 32 and 34, which are attached about their outer edges 36, reinforcing members 60 and 62 are preferably not attached about their outer edges. Handle receptacle member 70 is disposed in order to receive and retain distal end portion 16 of handle 12 within handle receiving chamber 74. Preferably, in addition to receptacle member 70, corresponding hook and loop fastening tabs 50 and 51 are employed to removably retain pad assembly 30. Fastening tabs 50 are mounted at least partially on inside surfaces 61 and 63 of reinforcing members 60 and 62, respectively, to secure distal end portion 16 of handle 12 which are provided with corresponding fastening tabs 51, when distal end portion 16 is inserted within handle receptacle member 70 within pocket 40 of pad assembly 30. Although hook and loop fastening tabs 50 and 51 are preferred to removably retain pad assembly 30 to handle 12, other fastening means for fastening pad assembly 30 to handle 12 may be employed such as buttons, snaps, hooks, etc. without departing from the scope of the present invention.

Fastening tabs 50 are secured to inside surfaces 61 and 63 by double-sided adhesive tabs 65. Likewise, handle receptacle member 70 is secured to inner surfaces 61 and 63 with similar double-sided adhesive tabs 66. Fastening tabs 51 are preferably mounted on the distal end portion 16 of handle 12 using glue or other adhesive material. It should be noted that although glue and double-sided adhesive tabs are preferred as described above, other mounting means such as tape, staples, etc. may be used to secure fastening tabs 50 to reinforcing members 60 and 62, and corresponding fastening tabs 51 to distal end portion 16 of handle 12.

Figure 5:
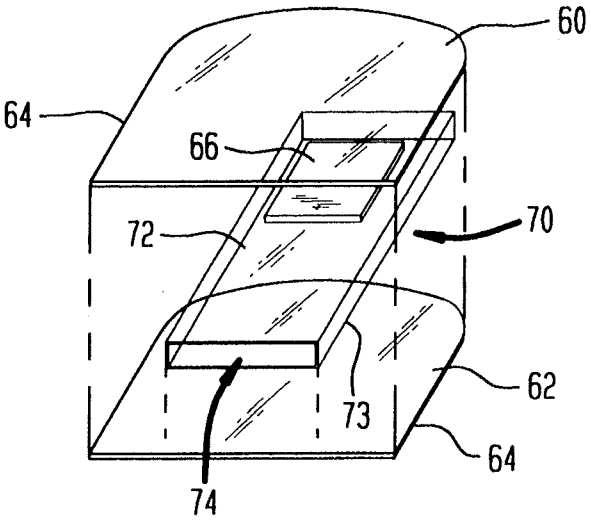
FIG. 5 is an exploded front perspective view of two reinforcing members and a handle receptacle member therebetween according to FIGS. 1 to 4 of the present invention.
Figure 6:
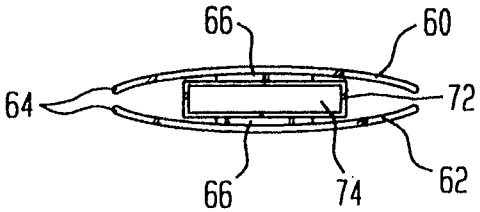
FIG. 6 is a bottom view of the assembly of FIG. 5 in the closed or assembled position.

In FIGS. 5 and 6, reinforcing members 60 and 62 are shown in an exploded view with handle receptacle member 70 disposed therebetween. As can be seen from FIG. 6, when reinforcing members 60 and 62 are secured to handle receptacle member 70 by adhesive tabs 66, outer edges 64 of reinforcing members 60 and 62 are not attached to one another. In this manner, when the assembly of reinforcing members 60 and 62 and handle receptacle member 70 of FIG. 6 is disposed within pocket 40 of pad assembly 30 as shown in FIG. 3, reinforcing members 60 and 62 will more easily deflect and bend with the bending and flexure of pad members 32 and 34 to provide sufficient flexure in order to apply lotion to the curves and contours of the human body.

Figure 7:
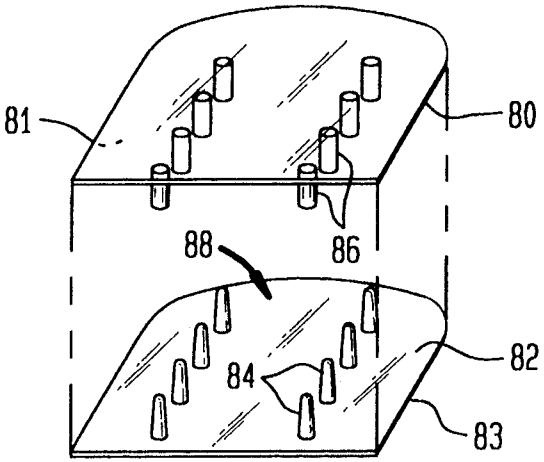
FIG. 7 is an exploded front perspective view of two reinforcing members according to another aspect of the present invention.
Figure 8:
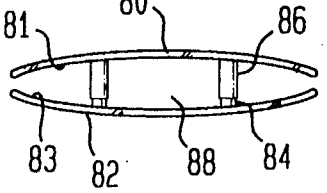
FIG. 8 is a bottom view of the closed assembly of FIG. 7 in the closed or assembled position.

In FIGS. 7 and 8, another preferred of the reinforcing members is shown. Specifically, reinforcing member 82 in this embodiment is provided with a series of posts 84 projecting perpendicularly upward from inside surface 83 of reinforcing member 82 and toward inside surface 81 of reinforcing member 80. Correspondingly disposed on inside surface 81 of reinforcing member 80 are post receptors 86, likewise perpendicular to and disposed downward on inside surface 81. The terms "upward" and "downward" are used herein to indicate directions relative to the reinforcing members themselves. It should be understood as referring to the frame of reference of the reinforcing members themselves, and not to the ordinary gravitational frame of reference. Upon closure of reinforcing member 80 on member 82, posts 84 are retained in post receptors 86 and define therebetween a handle receiving space 88 adapted to receive and retain the distal end portion 16 of elongate handle 12.

Reinforcing members 60 and 62 or 80 and 82 are preferably formed from a thin sheet-like plastic material such as a sheet of semi-rigid polyvinyl chloride having a preferred thickness of about 0.010". However, any similar semi-rigid material such as a polyethylene may be employed instead. Likewise, handle receptor 70 is preferably formed from such plastic materials folded about parallel score lines 73 (FIG. 5) to form a rectangular enclosure similar to that of an outer shell of a matchbox.

Although the preferred embodiment of the present invention employs a flat handle 12, a cylindrical or semi-cylindrical handle, or a handle having a flat distal end and a round proximal end, etc. may be employed. Thus, for example, if handle 12 has a cylindrical shape such as that of a typical broom handle, handle receptacle member 70 would likewise be cylindrical to receive and snugly retain distal end 16 of handle 12. Thus, the exact contour of the handle is not important, but rather the critical feature is the snug retaining of the distal end of the handle to prevent distal end 16 from moving or swaying about within pocket 40 of pad assembly 30. Furthermore, although the preferred embodiment employs two pad members 32 and 34, it is still possible to employ only one of such pad members and one reinforcing member attached to the surface of that pad member. Likewise, a single pad member could also be attached to only one reinforcing member of a two-member assembly such as an assembly shown in either FIG. 6 or FIG. 8.

In operation, the user applies the desired amount of sun lotion or the like to one or both flexible pad members 32 and 34 and then applies the same to any desired body parts, including the back. In the illustrated embodiments, reinforcing members 60 and 62, or 80 and 82, are substantially non-porous such that excess amounts of lotion applied to pad members 32 and 34 and absorbed thereby, will be forced or squeezed out from within the pad members when pressure is applied to the pad members against reinforcing members 60 and 62 or 80 and 82. When the user is finished applying the lotion and desires to discard the used lotion applicator pad assembly 30, the user simply unfastens the pad assembly from elongate handle 12, discards the same, and places and attaches a new pad assembly over distal end portion 16 of handle 12.

Although the invention herein has been described with reference to particular embodiments, it is to be understood that these embodiments are merely illustrative of the principles and applications of the present invention. It is therefore to be understood that numerous modifications may be made to the embodiments described herein and that other arrangements may be devised without departing from the spirit and scope of the present invention as defined by the appended claims.

What is claimed is:

1. A lotion applicator for applying sun lotion and liquids to the body, comprising:

an elongate handle having a proximal end and a distal end;

a detachable lotion applicator pad assembly comprising two porous, flexible pad members attached substantially about their edges except at an opening to define a pocket therebetween in communication with said opening;

two semi-rigid reinforcing members disposed in said pocket and corresponding substantially to the shape of said pad members; and fastening means for removably securing said pad assembly to said distal end of said handle, said fastening means being operative to connect said distal end of said handle to at least one of said reinforcing members when said distal end is disposed between said two reinforcing members.

2. The lotion applicator as claimed in claim 1, wherein said pad assembly further comprises means to firmly retain said distal end of said handle between said reinforcing members to prevent said distal end of said handle from moving and slipping about within said pocket.

3. The lotion applicator as claimed in claim 2, wherein said retaining means comprises a handle receptacle member attached to at least one of said reinforcing members and having a body defining a handle receiving chamber therein, said chamber being formed to correspond to a contour of said distal end of said handle and to snugly receive said distal end of said handle.

4. The lotion applicator as claimed in claim 2, wherein said retaining means comprises a plurality of posts disposed on a surface of one of said reinforcing members and said posts projecting from said one reinforcing member toward the other said reinforcing member, said posts being positioned in two parallel rows spaced apart to a width closely matching a width of said distal end of said handle, and a plurality of post receptors on the other said reinforcing member, said post receptors being disposed in a pattern corresponding to said rows of posts, such that when said reinforcing members are closed upon one another, said posts are retained in said post receptors, and a handle receiving space is defined by said parallel rows of said posts and post receptors to receive and retain said distal end of said handle.

5. The lotion applicator as claimed in claim 1, wherein said fastening means includes two fastening elements disposed on said distal end of said handle and two corresponding fastening elements, one of said corresponding fastening elements being mounted on each of said reinforcing members.

6. The lotion applicator as claimed in claim 5, wherein said fastening elements and said corresponding fastening elements comprises hook and loop fasteners.

7. The lotion applicator as claimed in claim 1, wherein said reinforcing members are disposed within said pocket and not attached to one another about their outer edges to provide increased flexure of said pad assembly.

8. A detachable lotion applicator pad assembly comprising:

two porous, flexible pad members attached substantially about their edges except at an opening to define a pocket therebetween in communication with said opening;

two semi-rigid reinforcing members disposed in said pocket and corresponding substantially to the shape of said pad members; and fastening means adapted to removably secure said pad assembly to a distal end of a handle, said fastening means being further adapted to connect the distal end of said handle to at least one of said reinforcing members when the distal end is disposed between said two reinforcing members.

9. The detachable lotion applicator pad assembly as claimed in claim 8, wherein said pad assembly further comprises means to firmly retain the distal end of the handle between said reinforcing members to prevent the end of the handle from moving and slipping about within said pocket.

10. The detachable lotion applicator pad assembly as claimed in claim 9, wherein said retaining means comprises a handle receptacle member attached to at least one of said reinforcing members and having a body defining a handle receiving chamber therein, said chamber being formed to correspond to the distal end of the handle and to snugly receive the distal end of the handle.

11. The detachable lotion applicator pad assembly as claimed in claim 9, wherein said retaining means comprises a plurality of posts disposed on a surface of one of said reinforcing members and said posts projecting from said one reinforcing member toward the other said reinforcing member, said posts being positioned in two parallel rows spaced apart to a width closely matching a width of said distal end of said handle, and a plurality of post receptors on the other said reinforcing member, said post receptors being disposed in a pattern corresponding to said rows of posts, such that when said reinforcing members are closed upon one another, said posts are retained in said post receptors, and a handle receiving space defined by said parallel rows of said posts and post receptors to receive and retain the distal end of the handle.

12. The detachable lotion applicator pad assembly as claimed in claim 8, wherein said reinforcing members are disposed within said pocket and not attached to one another about their outer edges to provide increased flexure of said pad assembly.

* * * * *